US006328305B1

(12) United States Patent
Yuan

(10) Patent No.: US 6,328,305 B1
(45) Date of Patent: Dec. 11, 2001

(54) CASINO GAME

(76) Inventor: Tsuan Yuan, 4628 Nolan La., Las Vegas, NV (US) 89107

( * ) Notice: Subject to any disclaimer, the term of this patent is extended or adjusted under 35 U.S.C. 154(b) by 0 days.

(21) Appl. No.: 09/468,533

(22) Filed: Dec. 21, 1999

Related U.S. Application Data

(63) Continuation-in-part of application No. 09/159,138, filed on Sep. 23, 1998, now abandoned.

(51) Int. Cl.[7] ..... A63F 3/08
(52) U.S. Cl. ..... 273/274; 273/292
(58) Field of Search ..... 273/274, 292, 273/293

(56) References Cited

U.S. PATENT DOCUMENTS 5,294,128 * 3/1994 Marquez .
5,788,241 * 8/1998 Ung .
5,857,677 * 1/1999 SumChau .
5,931,472 * 8/1999 Ko .
5,944,314 * 8/1999 Stavinsky .

OTHER PUBLICATIONS

Pai Gow, Commerce Casino, 6131 E. Telegraph Rd., Commerce, CA90040, World gaming congress and expo, Las Vegas, Oct. 14, 1997.*

* cited by examiner

*Primary Examiner*—Benjamin H. Layno
*Assistant Examiner*—V K Mendiratta
(74) *Attorney, Agent, or Firm*—Robert & Ryan Morishita; Anderson & Morishita

(57) ABSTRACT

A casino game played between a dealer and a player using a set of Pai Gow tiles, each tile including a pattern of pips defining a ranking for the tile begins with each player making an initial wager. The dealer deals three tiles to the dealer and to each player. The dealer and each player arrange the dealt tiles into a single-tile hand and a two-tile hand. Wagers are resolved by first comparing the rank of the player's single-tile hand to the dealer's single-tile hand. The single-tile hand with the higher ranking is the winning single-tile hand. Next, the dealer compares the sum of the pips shown on the face of the tiles of the player's two-tile hand to the sum of the pips shown on the tiles of the dealer's two-tile hand. The two-tile hand with the higher sum is the winning two-tile hand. If the sum of the player's two-tile hand equals the sum of the dealer's two-tile hand, the dealer may compare the rank of higher ranking tile of the player's two-tile hand to the rank of the higher ranking tile of the dealer's two-tile hand or, alternatively, compare the rank of the player's two-tile hand to the rank of the dealer's two-tile hand. The player is paid if the player wins both the single-tile hand and the two-tile hand. The player's wager is collected if the dealer wins both the single-tile hand and the two-tile hand or wins one hand and ties the second hand or ties both hands. The game is a push and the player's wager is neither paid nor collected if the player and the dealer each have one winning hand.

2 Claims, 2 Drawing Sheets

CASINO GAME

RELATED APPLICATION DATA

The present application is a continuation-in-part of application Ser. No. 09/159,138 filed Sep. 23, 1998 abandoned Apr. 25, 2000 by Applicant herein.

FIELD OF THE INVENTION

The present invention relates to casino games. Specifically, the present game is a wagering game utilizing Chinese tiles.

BACKGROUND OF THE INVENTION

Pai Gow is a well known gambling game which originated in China and is played with a set of thirty two tiles. Each tile includes a number of pips which indicate the rank of the tile. For reasons of tradition, the rank of the tile is not directly related to the number of pips on the tile. For example, a tile with twelve pips is the highest ranking tile; a tile with three pips is the lowest ranking tile.

A game of Pai Gow begins with the players making a wager. The dealer separates the tiles into eight piles of four tiles each. Three dice are rolled to determine the distribution of the tile hands. The tile hands are distributed to the players and each player organizes his or her tiles into a high hand and a low hand with each hand having two tiles. The low hand must have a lower ranking than the high hand according to the well known ranking of Pai Gow tiles. The dealer likewise organizes his or her tiles into high and low hands.

The wagers are resolved by comparing the rank of the player's high hand and low hand to the dealer's high hand and low hand, respectively. If both the player's high and low hands outrank the dealer's high and low hands, the player wins and is payed even money, less a five percent commission to the casino. If the dealer's high and low hands outrank the player's high and low hands, the dealer collects the player's wager. If one, but not both, of the player's hands outrank the one of the dealer's hands, the game is a push and the wager is neither collected nor paid.

Another game which utilizes Chinese tiles is called Tien Gow. The object of Tien Gow is to win points by taking tricks, much like card games such as bridge or hearts. To play Tien Gow, eight tiles are dealt to each player. One player leads by playing a tile combination composed of one to four tiles. Each player, in turn, plays a set composed of the same number of tiles. After all four players have played, the player who played the highest ranking set takes the trick. Tien Gow uses a ranking system similar to Pai Gow but has heretofore not been a viable game for use in casinos because the large number of tiles used in the game (eight rather than four) and the potential for cheating or cooperative play.

It can be seen that there is a need in the art for a gambling game different from Pai Gow which uses Chinese tiles and may be played in casinos.

SUMMARY OF THE INVENTION

A casino game played between a dealer and at least one player using a set of Pai Gow tiles begins with each player making an initial wager. The dealer deals three tiles to himself or herself and to each player. The dealer and the players arrange the dealt tiles into two hands: a single-tile hand and a two-tile hand.

The dealer resolves each player's wager by comparing the dealer's single-tile hand to each player's single-tile hand and the dealer's two-tile hand to each player's two-tile hand. With respect to the single-tile hands, the dealer compares the rank of the player's single-tile hand to the dealer's single-tile hand. The single-tile hand with the higher ranking is the winning single-tile hand. If the rank of the player's single-tile hand equals the rank of the dealer's single-tile hand, the single-tile hands are declared tie hands. In ranking the single-tile hands, the conventional rankings of Pai Gow are used.

The dealer next compares the sum of the pips shown on the face of the tiles of the player's two-tile hand to the sum of the pips shown on the tiles of the dealer's two-tile hand. In an optional embodiment, the sum may be modulo ten. The two-tile hand with the higher sum is the winning two-tile hand. If the sum of the player's two-tile hand equals the sum of the dealer's two-tile hand, the dealer next compares the Pai Gow rank of the player's two-tile hand to the rank of the dealer's two-tile hand or, in an alternate optional embodiment, the ranks of the highest ranking tile of the player's two-tile hand and the highest ranking tile of the dealer's two-tile hand. The hand with the higher Pai Gow ranking, or in the alternate embodiment, the higher ranking tile, is the winning two-tile hand. If the player's two-tile hand is equal in sum and rank to the dealer's two-tile hand, the two-tile hands are considered tied.

The player is paid according to his or her wager if the player has a winning single-tile hand and a winning two-tile hand. A push is declared and the wager is neither rewarded nor collected if the player has only one winning hand. The player's wager is collected if the dealer has a winning single-tile hand and a winning two-tile hand or one winning hand and a tie hand or two tie hands.

DESCRIPTION

Figure 1:
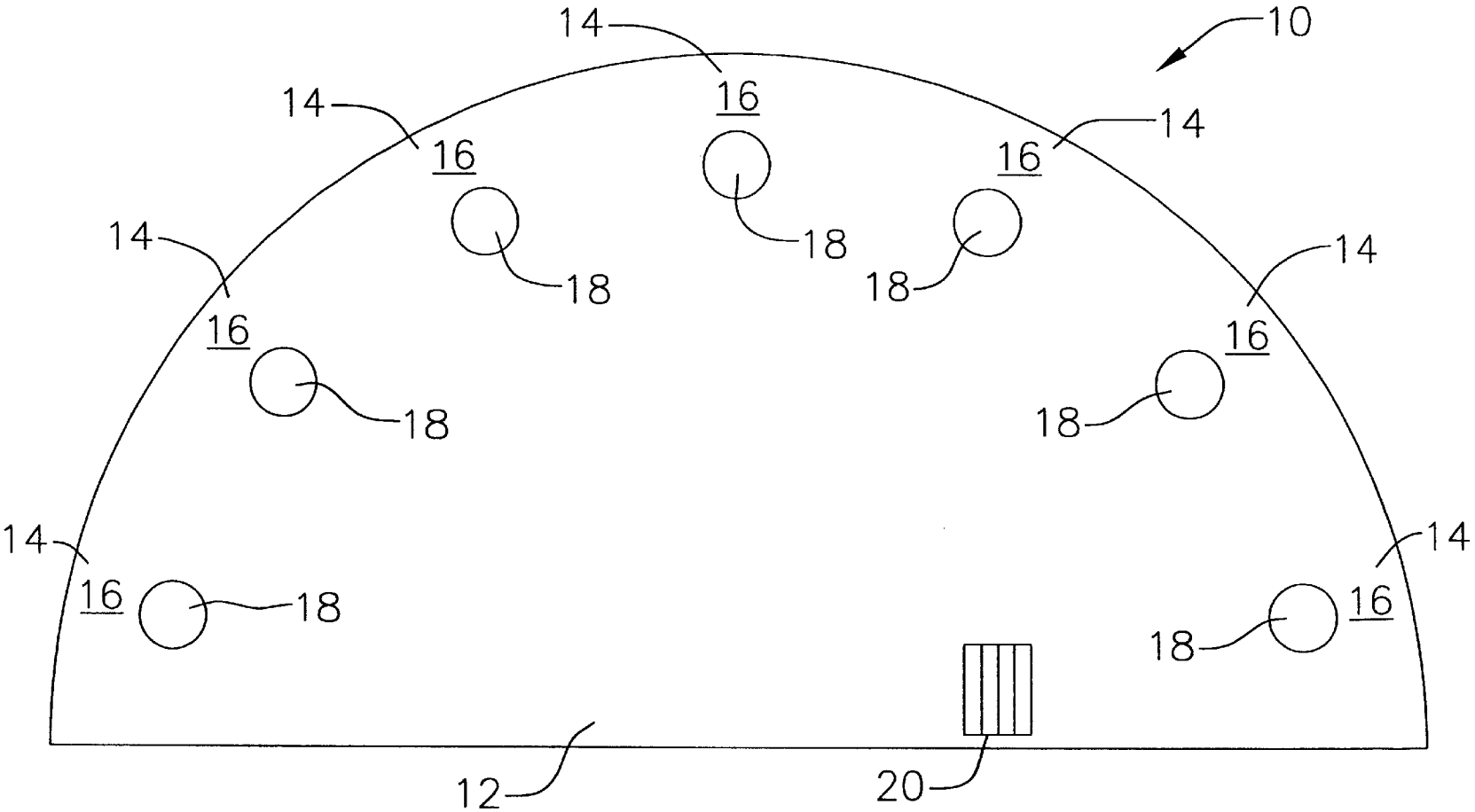
FIG. 1 is a top view of the playing surface used according to an embodiment of the present invention.

Reference is now made to the figures wherein like parts are referred to by like numerals throughout. With reference to FIG. 1, the present game is played on a playing surface 10. In an optional embodiment, the playing surface 10 is a table surface with indicia thereon such as a casino table with a felt playing surface. The surface preferably includes a dealer area 12 and a plurality of player areas 14, each of which having an action area 16 where the tiles may be dealt and arranged and a wager area 18. The dealer area 12 preferably includes a check rack 20 for holding casino checks or chips representing money.

The game of the present invention is played between a dealer and at least one player using a set of twenty four Chinese tiles. Alternatively, the game may be played between one of the players, designated a banker, and the other players. In such an embodiment, each player plays against the banker as if the banker were the dealer. Thus, in the description below, the word "dealer" may refer to a dealer or to a player acting as the banker.

The game begins with the player placing a wager in the wager area 18. The dealer shuffles the tiles and arranges the tiles into eight stacks of three tiles each. The dealer assigns the stacks to players. In an optional embodiment, three dice are rolled to determine which player receives the first stack of tiles. The players are numbered in a counter-clockwise fashion according to their locations. If the dealer rolls a player's number, that player receives the first stack of tiles. The remaining stacks of tiles are distributed to the remaining players. Any remaining stacks of tiles are removed from play.

Figure 2:
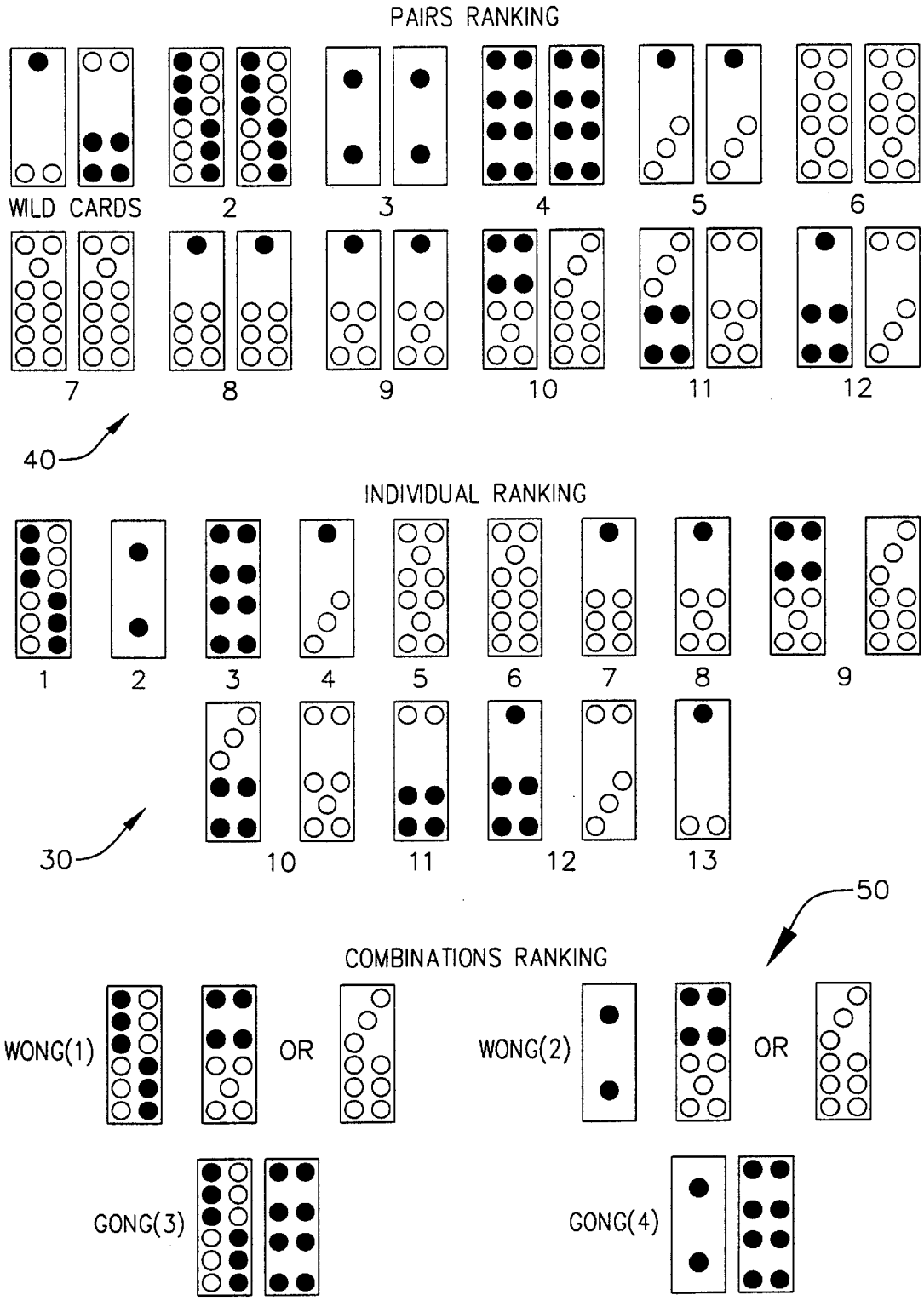
FIG. 2 is a chart of the ranks of tile hands in ascending order according to an embodiment of the present invention.

The dealer and the players arrange their three tile hand into two hands: a single-tile hand and a two-tile hand. As shown in FIG. 2, the rank of the tiles is determined by a known ranking system and is not directly related to the number of pips on the tile. While there are no rules about how each player must arrange his or her hands, the strategy will become evident as the method of play is described below. In an optional embodiment, the casino may have a set of house rules which the dealer must follow to insure that the dealer arranges the tiles to form the highest hands possible. For example, the following house rules may apply:

A. If the dealer has one tile with twelve, two, eight, or four pips, this tile is used as the single-tile hand, unless the dealer has an exception hand described below.

B. If the dealer has two tiles with twelve, two, eight, or four pips, the lower tile is used as the single-tile hand unless the dealer has a twelve and a two, in which case the twelve is used as the single-tile hand or an exception hand described below.

C. If the dealer has three tiles with twelve, two, eight, or four pips, the following rules apply:

a. For a hand with a twelve, two, and eight, the twelve is used as the single-tile hand.

b. For a hand with a twelve, two, and four, the twelve is used as the single-tile hand.

c. For a hand with a twelve or two, eight, and four, the four is used as the single-tile hand.

D. If the dealer has no tiles with twelve, two, eight, or four pips, the two tiles with the greatest number of pips are used in the two-tile hand. For example, if the dealer has a hand with a nine, a three, and a ten, the dealer would form a two tile hand using the nine and the ten.

E. Exception hands:

a. If the dealer has a twelve or two, a four, and a wild card, the twelve or two is used as the single-tile hand.

b. If the dealer has a four, a five, and a tile six through eleven, the four and five are used as the two-tile hand.

c. If the dealer has a twelve or two, an eleven, and a nine, the twelve or two and the nine are used as the two-tile hand.

F. Splitting pairs:

a. If the dealer has a pair of twelves, one twelve is used as the single-tile hand and the other twelve is used in the two-tile hand unless the third tile is a two.

b. If the dealer has a pair of twos, one two is used as the single-tile hand and the other two is used in the two-tile hand unless the third tile is a twelve, ten, or eleven.

c. If the dealer has a pair of eights, one eight is used as the single-tile hand and the other eight is used in the two-tile hand only if the third tile is a seven, nine, ten, or eleven.

d. If the dealer has a pair of fours, one four is used as the single-tile hand and the other four is used in the two-tile hand only if the third tile is a wild card or five.

e. If the dealer has a pair of wild cards, fives, sixes, sevens, nines, tens, or elevens, the pair is always used as the two-tile hand.

Once the dealer and players have arranged their hands, the dealer compares each player's hands against the dealer's hands. In comparing each player's hands against the dealer's hands, the single-tile hand is resolved by the individual rankings 30 of FIG. 2 while the two-tile hand is resolved by the sum of the pips on the tiles of the two-tile hand. That is, for each player, the player wins his or her wager if the player's single-tile hand outranks the dealer's single-tile hand, according to the individual rankings 30 of FIG. 2, and the sum of the pips on the tiles of the player's two-tile hand is greater than the sum of the pips on the tiles of the dealer's two-tile hand. In an optional embodiment, if the sum of the pips on the player's two-tile hand equals the sum of the pips on the dealer's two-tile hand, the pairs rankings 40 and combination rankings 50 of the two-tile hands are compared, with the higher ranking hand winning. In other words, the pairs rankings 40 and combinations rankings 50 of the two-tile hands are only compared if the two-tile hand is not resolved by comparing the sum of the pips of the tiles of the two-tile hands. In one embodiment of the present invention, the player is paid at even money less a five percent commission to the casino.

Conversely, a player's wager is collected if the dealer wins both hands or ties both hands or wins one hand and ties the other hand. That is, a player's wager is collected if the dealer's single-tile hand outranks or ties the player's single-tile hand and the sum of the pips in the dealer's two-tile hand is greater than or equal to the sum of the pips in the player's two-tile hand. Again, in an optional embodiment, if the sum of the pips in the dealer's two-tile hand equals the sum of the pips in the player's two-tile hand, the tie may be resolved by comparing the ranks of the two tiles in combination using the pairs ranking 40 and combinations ranking 50 or the rank of the highest ranking tile in the two-tile hand using the individual ranking 30.

Finally, if the player and dealer each win one hand, the game is a push and that player's wager is neither collected nor paid. That is, if the player's single-tile hand outranks the dealer's single tile hand and the dealer's two-tile hand outranks the player's two-tile hand, or vice versa, the game is a push and the player's wager is returned.

While certain embodiments of the present invention have been shown and described it is to be understood that the present invention is subject to many modifications and changes without departing from the spirit and scope of the claims presented herein.

I claim:

1. A method for playing a casino game between a dealer and at least one player using a set of Pai Gow tiles, each tile including a pattern of pips defining a Pai Gow rank for the tile, comprising:

each player making a wager;

the dealer dealing three tiles to the dealer and to each player, the dealer and each player arranging the dealt tiles into a single-tile hand and a two-tile hand; and resolving each player's wager comprising:

(a) comparing the Pai Gow rank of the player's single-tile hand to the dealer's single-tile hand, the single-tile hand with the higher Pai Gow rank being the winning single-tile hand, and if the Pai Gow rank of the player's single-tile hand equals the Pai Gow rank of the dealer's single-tile hand, the single-tile hands being tie hands;

(b) comparing the sum of the pips shown on the face of the tiles of the player's two-tile hand to the sum of the pips shown on the tiles of the dealer's two-tile hand, the two-tile hand with the greater sum being the winning two-tile hand, and if the dealer's two-tile hand and the player's two-tile hand have the same sum of pips, comparing the Pai Gow rank of the higher ranking tile in the player's two-tile hand and the higher ranking tile in the dealer's two-tile hand and declaring the two-tile hand with the higher ranking tile to be a winning two-tile hand or, if the player's two-tile hand and the dealer's two-tile hand have the same sum of pips and the higher ranking tile in the player's two-tile hand is equal in Pai Gow rank to the higher ranking tile in the dealer's two-tile hand, declaring the two-tile hands as tied; and (c) paying the player if the player wins both the single-tile hand and the two-tile hand, collecting the player's wager if the dealer wins both the single-tile hand and the two-tile hand or wins one hand and ties the second hand or ties both hands, and neither paying the player nor collecting the player's wager if the player has only one winning hand.

2. A method for playing a casino game between a dealer and at least one player using a set of Pai Gow tiles, each tile including a pattern of pips defining a ranking for the tile, comprising:

each player making an initial wager;

the dealer dealing three tiles to the dealer and to each player, the dealer and each player arranging the dealt tiles into a single-tile hand and a two-tile hand; and resolving each player's wager comprising:

comparing the Pai Gow rank of the player's single-tile hand to the dealer's single-tile hand, the single-tile hand with the higher Pai Gow rank being the winning single-tile hand, and if the Pai Gow rank of the player's single-tile hand equals the Pai Gow rank of the dealer's single-tile hand, the single-tile hands being tie hands;

comparing the sum of the pips, modulo ten, shown on the face of the tiles of the player's two-tile hand to the sum of the pips, modulo ten, shown on the tiles of the dealer's two-tile hand, the two-tile hand with the greater sum being the winning two-tile hand, and if the sum of the player's two-tile hand equals the sum of the dealer's two-tile hand, comparing the rank of higher ranking tile of the player's two-tile hand to the rank of the higher ranking tile of the dealer's two-tile hand, the two-tile hand containing the tile with the higher ranking being the winning two-tile hand, and if the sum and rank of the player's two-tile hand equal the sum and rank of the dealer's two-tile hand, the two-tile hands being tie hands; and paying the player if the player wins both the single-tile hand and the two-tile hand, collecting the player's wager if the dealer wins both the single-tile hand and the two-tile hand or wins one hand and ties the second hand or ties both hands, and neither paying the player nor collecting the player's wager if the player has only one winning hand.

* * * * *